US007302978B1

(12) United States Patent
Kolarik

(10) Patent No.: US 7,302,978 B1
(45) Date of Patent: Dec. 4, 2007

(54) WASTE DISPOSAL FUNNEL

(76) Inventor: Michael A. Kolarik, 1510 Kendall St., SE., Grand Rapids, MI (US) 49508

( * ) Notice: Subject to any disclaimer, the term of this patent is extended or adjusted under 35 U.S.C. 154(b) by 0 days.

(21) Appl. No.: 11/471,331

(22) Filed: Jun. 20, 2006

(51) Int. Cl.
*B65B 1/04* (2006.01)

(52) U.S. Cl. ..... 141/391; 248/99

(58) Field of Classification Search ..... 141/390, 141/391, 313–317, 10, 114; 248/99, 95
See application file for complete search history.

(56) References Cited

U.S. PATENT DOCUMENTS 2,430,155 A * 11/1947 Buttery ..... 141/390
5,271,589 A * 12/1993 Belous ..... 248/97
5,765,614 A * 6/1998 Kardosh ..... 141/390
6,007,030 A * 12/1999 Judge ..... 248/95
6,085,647 A * 7/2000 Burow ..... 100/295
6,135,518 A 10/2000 Holthaus

* cited by examiner

*Primary Examiner*—Steven O. Douglas
(74) *Attorney, Agent, or Firm*—Price, Heneveld, Cooper, DeWitt & Litton LLP

(57) ABSTRACT

A yard waste funnel includes first and second planar supports each having a neck edge and a support edge, wherein the first planar support is substantially parallel to the second planar support. A first funnel wall has a trapezoidal shape including a neck edge and a funnel edge. The neck edge of the first funnel wall is hingedly connected to the neck edge of the first support and the neck edge of the second funnel wall is hingedly connected to the neck edge of the second support. First and second connecting walls each have a trapezoidal shape including a neck edge and a funnel edge. The first connecting wall is hingedly connected to the first funnel wall at a first hinge and the second funnel wall at a second hinge. The second connecting wall is hingedly connected to the first funnel wall at a third hinge and to the second funnel wall at a fourth hinge. The yard waste funnel may be adjusted between an expanded position for collecting yard waste in a refuse bag and a collapsed position for storage.

15 Claims, 1 Drawing Sheet

10
12
14
20
22
74

10
20
28
30
32
38
40
42
44
46
50
52
54
56
58
60
62
63
64
65
66
68
70

10
16
18
24
26
32
38
40
42
50
52
58
60
70

10
16
18
24
26
28
32
38
42
50
52
54
56
58
60
76

WASTE DISPOSAL FUNNEL

BACKGROUND OF THE PRESENT INVENTION

The present invention relates to a funnel for yard waste and in particular to a funnel for yard waste that is easily expanded to funnel yard waste into a bag and collapsed for storage.

In much of the United States, each year in the autumn season, leaves from deciduous trees fall on the ground in the yard of millions of homeowners. In rural areas, these leaves can be raked or blown into a pile in the surrounding woods, or burned. However, in many urban areas, there are no surrounding woods and local ordinances forbid the use of fires to remove the leaves and other yard waste from the premises. Local governments often require that leaves and other yard waste be bagged for pickup by a waste collection vehicle or garbage truck. Most often, the bags are paper in construction which helps facilitate the quick and environmentally safe degradation of the bag and its contents. These bags are difficult to use as they do not have a rigid structure, and therefore do not stay open when a user attempts to place yard waste inside the bag. In addition, the mouth of the bag is small relative to its volumetric capacity, making it difficult to place a high volume of leaves, sticks, and branches in the bag in a time efficient manner. Systems for improving the collection of waste in these bags have been developed but are frequently large and bulky and are difficult to store because they do not collapse into a flat storage position.

Accordingly, a yard waste funnel that supports the refuse bag in an open position and facilitates the funneling of yard waste from a user's rake or hands into the bag and is easily collapsed to a flat storage position would be useful and an improvement in the art.

SUMMARY OF THE INVENTION

In one aspect of the present invention, a yard waste funnel includes first and second planar supports each having a neck edge and a support edge, wherein the first planar support is substantially parallel to the second planar support. A first funnel wall has a trapezoidal shape including a neck edge and a funnel edge. A second funnel wall is also included and has a trapezoidal shape including a neck edge and a funnel edge. The neck edge of the first funnel wall is hingedly connected to the neck edge of the first support and the neck edge of the second funnel wall is hingedly connected to the neck edge of the second support. First and second connecting walls each have a trapezoidal shape including a neck edge and a funnel edge. The first connecting wall is hingedly connected to the first funnel wall at a first hinge and the second funnel wall at a second hinge. The second connecting wall is hingedly connected to the first funnel wall at a third hinge and to the second funnel wall at a fourth hinge. The yard waste funnel may be adjusted between an expanded position for collecting yard waste in a refuse bag and a collapsed position for storage.

In another aspect of the present invention, a waste disposal system includes a collapsible funnel having an inverted pyramidal hollow frustum construction and further includes a first set of opposing walls and a second set of opposing walls, a funnel aperture and a neck aperture, wherein the neck aperture is smaller than the funnel aperture. First and second supports are hingedly connected to the first set of opposing walls. The supports are adapted to engage an opening in a refuse bag and hold the refuse bag open for receiving yard waste.

In yet another aspect of the present invention, a method of disposing waste includes opening a refuse bag and expanding a collapsible yard waste funnel that has two support columns attached to a four-sided mouth. The two support columns of the yard waste funnel are inserted into the refuse bag. Debris is placed into the mouth of the yard waste funnel, allowing the debris to collect inside the refuse bag. The yard waste funnel is removed from the refuse bag and collapsed to a substantially planar storage position. The refuse bag and the debris collected therein are then disposed of in a proper manner.

These and other features, advantages and objects of the present invention will be further understood and appreciated by those skilled in the art upon studying the following specification, claims, and appended drawings.

DETAILED DESCRIPTION OF PREFERRED EMBODIMENTS

Figures 1, 2, 3, 4:
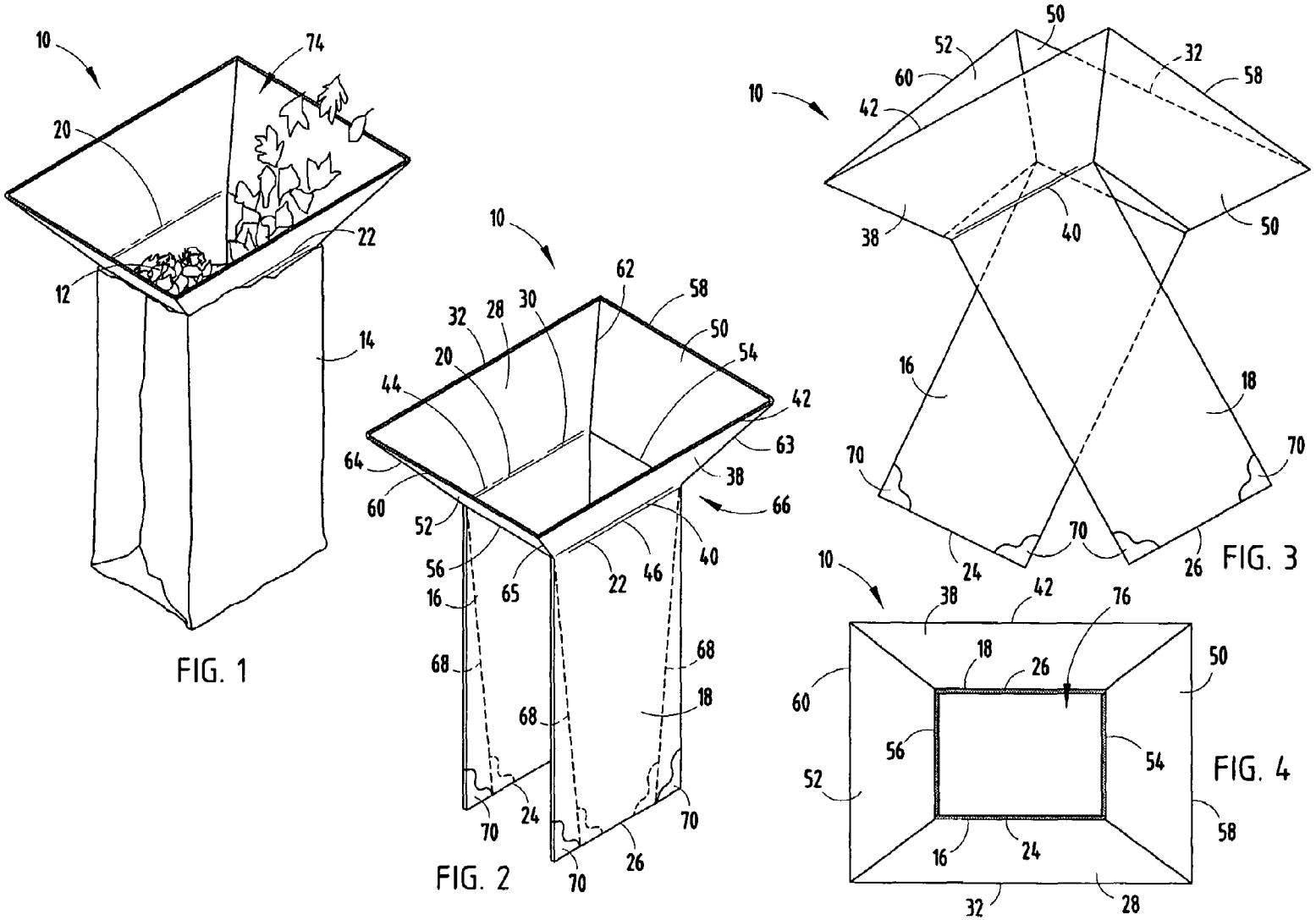
FIG. 1 is a top perspective view of the yard waste funnel embodying the present invention engaged with a refuse bag.
FIG. 2 is a top perspective view of the yard waste funnel of FIG. 1 removed from the bag in an expanded position.
FIG. 3 is a side elevational view of the yard waste funnel of FIG. 1 removed from the bag and in a collapsed position.
FIG. 4 is a bottom elevational view of the yard waste funnel of FIG. 2.

For purposes of description herein the terms "upper", "lower", "right", "left", "rear", "front", "vertical", "horizontal" and derivatives thereof shall relate to the invention as oriented in FIG. 2. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 10 (FIG. 1) generally designates a yard waste funnel which is shaped to facilitate the easy loading of yard waste 12 into a refuse bag 14. The yard waste funnel 10 includes first and second planar supports 16, 18 that each have a neck edge 20, 22 and a support edge 24, 26, respectively. The first planar support 16 is substantially parallel to the second planar support 18. A first funnel wall 28 is included and has a trapezoidal shape including a neck edge 30, and a funnel edge 32. A second funnel wall 38 is also included and has a trapezoidal shape including a neck edge 40 and a funnel edge 42. The neck edge 30 of the first funnel wall 28 is connected by a hinge 44 to the neck edge 20 of the first support 16 and the neck edge 40 of the second funnel wall 38 is connected by a hinge 46 to the neck edge 22 of the second planar support 18. Additionally, first and second connecting walls 50, 52 are included and each has a trapezoidal shape including a neck edge 54, 56 and a funnel edge 58, 60, respectively. The first connecting wall 50 is hingedly connected to the first funnel wall 28 at a first hinge 62 and the second funnel wall 38 at a second hinge 63.

Similarly, the second connecting wall 52 is hingedly connected to the first funnel wall 28 at a third hinge 64 and to the second funnel wall 38 at a fourth hinge 65. The yard waste funnel 10 may be adjusted between an expanded position (FIG. 2) for funneling yard waste 12 and a collapsed position (FIG. 3) for storage.

The connection of the first and second funnel walls 28, 38 with the first and second connecting walls 50, 52 creates an inverted pyramidal hollow frustum 66 that acts as a mouth that funnels yard waste 12 into the refuse bag 14. The hinges 62, 63, 64, and 65 are disposed at the corners and allow for the expansion of the yard waste funnel 10 during use and collapse of the yard waste funnel 10 for storage purposes. More specifically, the hinges 62, 63, 64, and 65 are disposed at the corners of the inverted hollow pyramidal frustum 66 and, when the yard waste funnel 10 is in the collapsed position (FIG. 3), allows for the yard waste funnel 10 to be folded relatively flat. It is contemplated that each of the hinges 62, 63, 64, and 65 could be a butt hinge or continuous hinge, but the preferred design incorporates a living hinge.

The first and second planar supports 16, 18 are substantially rectangular, however, it is contemplated that they may have slightly tapered vertical edges 68 to accommodate easy insertion of the yard waste funnel 10 into the refuse bag 14. Preferably, the supports 16, 18 have a width equal to or slightly less than an interior width of the refuse bag 14 so that the supports 16, 18 fit easily, yet snugly, inside the refuse bag 14. In addition, the supports 16, 18 have a height approximately equal to the height of the refuse bag 14. As a result, the inverted pyramidal hollow frustum 66 rests just above the top of the refuse bag 14. Corner supports 70 may be adhered or mechanically fastened to the ends of the support edges 24, 26. The corner supports protect the ends of the support edges 24, 26 from bending or breaking. As explained above with respect to the hinges 62, 63, 64 and 65, it is contemplated that the hinges 44, 46 could be a butt hinge or continuous hinge, but the preferred design incorporates a living hinge. The hinges 44, 46 allow the first and second funnel walls 28, 38 to tilt outwardly when the yard waste funnel 10 is expanded. Likewise, when the yard waste funnel 10 is collapsed, the hinges 44, 46 allow the first and second funnel walls 28, 38 to tilt inwardly until the first and second funnel walls 28, 38 are co-planar with the first and second planar supports 16, 18, respectively.

Referring now to FIG. 4, the funnel edges 32, 42 of the first and second funnel walls 28, 38 and the funnel edges 58, 60 of the first and second connecting walls 50, 52 define a funnel aperture 74 (FIG. 1) having a perimeter with an area that is approximately four times greater than the area of a neck aperture 76 defined by the perimeter of the neck edges 30, 40 of the first and second funnel walls 28, 38 and the neck edges 54, 56 of the first and second connecting walls 50, 52. Accordingly, a user can dump a large volume of yard waste 12 into the refuse bag 14 using the yard waste funnel 10 and minimize the likelihood that some of the yard waste 12 will fall outside the refuse bag 14 while also shortening the time necessary to fill the bag.

The material from which the yard waste funnel 10 is constructed is preferably corrugated plastic (shown in FIGS. 1, 2, and 4) or corrugated cardboard. However, plastic, cardboard, wood, paper, wood fiber, aluminum, lightweight steel or other suitable material may also be used. The same materials may be used for the corner supports 70.

A user would typically dispose of the yard waste using this yard waste funnel 10 by completing the following steps. The user would first open a refuse bag 14 that is used for storing and disposing of yard waste 12. The collapsible yard waste funnel 10 would then be expanded and the supports 16, 18 of the yard waste funnel 10 would be inserted into the refuse bag 14. The user would then place yard waste or debris into the mouth of the yard waste funnel 10 and allow the yard waste 12 to gather inside the refuse bag 14. When the refuse bag 14 has been filled to a desired level, the yard waste funnel 10 would then be removed from the refuse bag 14 and the yard waste funnel 10 would be collapsed to the substantially planar storage position and stored. Finally, the refuse bag 14 filled with the yard waste 12 would be disposed properly.

Optionally, the yard waste funnel 10 could be set on a surface so that the mouth of the yard waste funnel 10 rests on the surface and the supports 16, 18 project upwardly. The refuse bag 14 could then be placed over the supports and the refuse bag 14 and yard waste funnel 10 could be flipped over so that the refuse bag can be filled.

In the foregoing description, it will be readily appreciated by those skilled in the art that modifications may be made to the invention without departing from the concepts disclosed herein. Such modifications are to be considered as included in the following claims, unless these claims, by their language, expressly state otherwise.

The invention claimed is:

1. A yard waste funnel comprising:

first and second planar supports each having a neck edge and a support edge, wherein the first planar support is substantially parallel to the second planar support;

first and second funnel walls each having a trapezoidal shape including a neck edge and a funnel edge, wherein the neck edge of the first funnel wall is hingedly connected to the neck edge of the first support and the neck edge of the second funnel wall is hingedly connected to the neck edge of the second support; and first and second connecting walls each having a trapezoidal shape including a terminal neck edge and a funnel edge, wherein the first connecting wall is hingedly and integrally connected to the first funnel wall by a first hinge and the second funnel wall by a second hinge and wherein the second connecting wall is hingedly and integrally connected to the first funnel wall by a third hinge and to the second funnel wall by a fourth hinge and further wherein said yard waste funnel may be adjusted between an expanded position for collecting yard waste in a refuse bag and a collapsed position for storage.

2. The yard waste funnel of claim 1, wherein:

the supports are substantially rectangular.

3. The yard waste funnel of claim 1, wherein:

the support edge includes ends reinforced with corner supports.

4. The yard waste funnel of claim 3, wherein:

the yard waste funnel is comprised of a wood fiber.

5. The yard waste funnel of claim 3, wherein:

the yard waste funnel is comprised of plastic.

6. The yard waste funnel of claim 5, wherein:

the plastic is corrugated.

7. The yard waste funnel of claim 1, wherein:

the funnel is substantially planar when in the collapsed position.

8. A waste disposal system comprising:

a collapsible funnel having a hollow pyramidal frustum construction that includes a first set of opposing walls and a second set of opposing walls having top and bottom terminal edges and first and second side hinges hingedly and integrally attached to the first set of opposing walls, wherein the first set of opposing walls and second set of opposing walls define a funnel aperture and a neck aperture, wherein the neck aperture is smaller than the funnel aperture; and first and second supports hingedly connected to the first set of opposing walls, wherein the supports are adapted to engage an opening in a refuse bag and hold the refuse bag open for receiving yard waste.

9. The waste disposal system of claim 8, wherein:

the supports are substantially rectangular.

10. The waste disposal system of claim 9, wherein:

the yard waste funnel is comprised of a wood fiber.

11. The waste disposal system of claim 9, wherein:

the yard waste funnel is comprised of plastic.

12. The waste disposal system of claim 11, wherein:

the plastic is corrugated.

13. The waste disposal system of claim 7, wherein:

the first and second supports have a bottom edge that includes corner supports that prevent the bottom edge from being deformed.

14. A method of disposing of waste comprising:

opening a refuse bag;

forming a collapsible yard waste funnel having a first set of opposing walls and a second set of opposing walls that define a mouth;

providing a terminal bottom edge on the second set of opposing walls;

connecting support columns to the first set of opposing walls;

expanding the collapsible yard waste funnel;

inserting the support columns of the yard waste funnel into the refuse bag;

placing debris into the mouth of the yard waste funnel;

allowing the debris to gather inside the refuse bag; and removing the yard waste funnel from the refuse bag.

15. The method of claim 14, further comprising the steps of:

placing the mouth of the yard waste funnel on a surface such that the support columns protrude upwardly;

placing the bag over the support columns; and rotating the yard waste funnel and refuse bag such that the support columns elevate and support the mouth.

* * * * *